United States Patent [19]

Engel

[11] 4,147,962

[45] Apr. 3, 1979

[54] ENERGY-CONSERVING ILLUMINATION SYSTEM

[75] Inventor: Joseph C. Engel, Monroeville, Pa.

[73] Assignee: Westinghouse Electric Corp., Pittsburgh, Pa.

[21] Appl. No.: 861,591

[22] Filed: Dec. 19, 1977

[51] Int. Cl.[2] ..... G05F 1/00; H05B 37/02; H05B 39/04; H05B 41/36

[52] U.S. Cl. ..... 315/291; 307/141; 315/293; 315/DIG. 7

[58] Field of Search ..... 315/291, 293, 294, 297, 315/307, 360, 362, DIG. 4, DIG. 7; 307/141; 340/33.5

[56] References Cited

U.S. PATENT DOCUMENTS

| | | | |
|---|---|---|---|
| 3,885,197 | 5/1975 | Moses | 315/DIG. 4 |
| 3,940,660 | 2/1976 | Edwards | 315/DIG. 4 |

*Primary Examiner*—Alfred E. Smith
*Assistant Examiner*—Robert E. Wise
*Attorney, Agent, or Firm*—R. S. Lombard

[57] ABSTRACT

An energy-conserving solid-state-controlled illumination system which operates high-intensity-discharge lamps. The system operates the lamps at about a predetermined rated power consumption with a relatively high light output for a predetermined time when a high degree of illumination is desirable and thereafter operates the lamps at about a predetermined power less than rated power consumption when a lower degree of illumination can be tolerated.

6 Claims, 2 Drawing Figures

ENERGY-CONSERVING ILLUMINATION SYSTEM

CROSS-REFERENCE TO RELATED APPLICATION

In copending application Ser. No. 861,587, filed Dec. 19, 1977, and owned by the same assignee, is disclosed a lighting system which operates lamps with a relatively high light output for a predetermined proportion of the night when a high degree of illumination is desirable and then operates the lamps with a lower light output when a lower degree of illumination can be tolerated. The system constitutes an improvement over the present system in that it automatically compensates for seasonal variations in the length of the night.

BACKGROUND OF THE INVENTION

This invention relates to control systems for vapor-discharge lamps and, more particularly, to a control system which automatically dims the lamps after a predetermined time when a lower degree of illumination can be tolerated.

In recent years much effort has been directed toward developing lighting systems that are energy-conserving. Much energy is wasted by present day outdoor lighting systems, such as those used for street lighting and parking areas because these systems were not designed to operate at more than one power consumption level. There have been attempts to conserve energy with these present systems such as, turning a portion of the lights in a system completely off. This approach though conserving energy may be a safety hazard because of the poor lighting distribution that may result. The present invention constitutes an improvement over such an approach, in that, it provides for automatic dimming of an entire lighting system with uniform light distribution.

SUMMARY OF THE INVENTION

This invention provides an energy-conserving solid-state-controlled illumination system which operates high-intensity-discharge lamps at about predetermined rated power with a relatively high light output for a predetermined time when a higher degree of illumination is desirable. Thereafter, the system operates the lamps at about a predetermined power less than rated power consumption when a lower degree of illumination can be tolerated.

The system comprises input terminal means adapted to be connected to a source of electrical energy and output terminal means adapted to be connected to the input terminals of the lamp means. Lamp ballasting means is provided in circuit with the lamp means between the input terminal means and the output terminal means. The lamp ballasting means has a first operating mode in which the average power passed to the lamp means causes same to operate at about rated power consumption. The lamp ballasting means also has a second operating mode in which the average power passed to the lamp means is a predetermined amount less than the rated power consumption for the lamp means.

The system also comprises main switching means having an open state and a closed state. The main switching means is connected in circuit with the input terminal means and the lamp ballasting means to energize the lamp means when the switching means is in the closed state and to deenergize the lamp means when in the open state. Controlled switching means is also provided, the controlled closing and opening of which determines whether the ballasting means is in the first operating mode or in the second operating mode.

The system further comprises timing means responsive to the closing of the main switching means. The timing means is operable to generate a time-related control signal a predetermined period of time after the closing of the main switching means. The generated time-related control signal causes the controlled switching means to switch from the first operating mode to the second operating mode until the system is de-energized by the main switching means. The system is thereafter quiescent until the main switching means is again closed.

The timer means preferably comprises oscillator means for generating timed pulses after the closing of the main switching means and digital counter means for counting a predetermined number of pulses generated by the oscillator means. The digital counter means initiates the time-related control signal after the predetermined number of pulses are counted.

The controlled switching means typically comprises a solid-state gate-controlled switching means and gate control means responsive to the time-related control signal generated by the timing means. The gate control means has an output connected to the gate of the gate-controlled switching means to control the mode of the ballasting means.

The digital counter means preferably has a reset state corresponding to a number at which the count begins. The reset state is typically controlled by a control means to cause the digital counter means to reset upon predetermined conditions occurring.

BRIEF DESCRIPTION OF THE DRAWINGS

The invention can best be understood by reference to the following drawings, in which.

DESCRIPTION OF THE PREFERRED EMBODIMENTS

Figure 1:
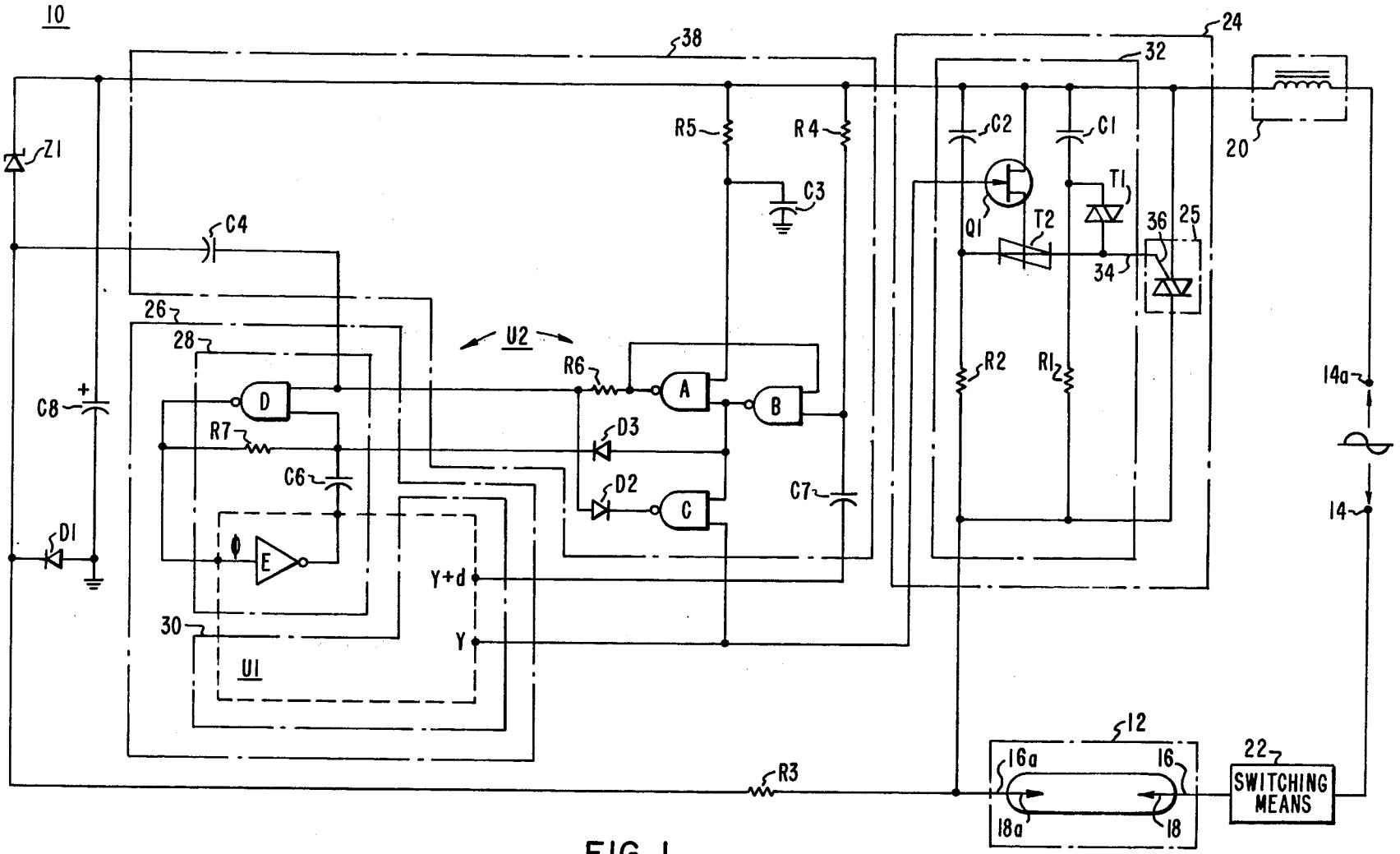
FIG. 1 is a schematic diagram of a preferred circuit configuration of the invention with a lag-type ballast.

In FIG. 1 is shown an energy-conserving solid-state-controlled illumination system 10 which operates high-intensity-discharge lamp means 12 at about a predetermined rated power consumption with a relatively high light output for a predetermined time when a high degree of illumination is desirable and thereafter operates the lamp means 12 at about a predetermined power less than rated power consumption when a smaller degree of illumination can be tolerated. The system comprises input terminal means 14, 14*a* adapted to be connected to a source of electrical energy and output terminal means 16, 16*a* adapted to be connected to the input terminals 18, 18*a* of the lamp means 12.

The system also comprises lamp ballasting means 20 which as shown in FIG. 1 is a lag-type ballast. Lamp ballasting means 20 is in circuit with the lamp means 12. The lamp ballasting means 20 has a first operating mode in which the average power passed to the lamp causes same to operate at about rated power consumption. The lamp ballasting means 20 also has a second operating mode in which the average power passed to the lamp 12 is a predetermined amount less than the rated power consumption for the lamp.

The system 10 further comprises main switching means 22 having an open state and a closed state. The main switching means 22 may be a photocontrol switch, for example, or a manual, centrally located switch controlling a bank of lamps. The main switching means 22 is connected in circuit with the input terminal means 14, 14*a* and the lamp ballasting means 20 to energize the lamp 12 when the switching means 22 is in the closed state and to de-energize the lamp 12 when in the open state. Controlled switching means 24 is provided, the controlled closing and opening of which determines whether the ballasting means 20 is in the first operating mode or second operating mode.

The system 10 also further comprises timing means 26 responsive to the closing of the main switching means 22 and is operable to generate a time-related control signal a predetermined period of time after the closing of the main switching means 22. The time-related control signal generated by the timing means 26 causes the controlled switching means 24 to switch from the first operating mode to the second operating mode until the system 10 is de-energized by the main switching means 22. The system is thereafter quiescent until the main switching means 22 is again closed.

The timing means 26 preferably comprises oscillator means 28 for generating timed pulses after the closing of the main switching means 22 and digital counter means 30 for counting a predetermined number of pulses generated by the oscillator means 28. The digital counter means 30 initiates the time-related control signal after the predetermined number of pulses are counted.

The controlled switching means 24 preferably comprises a solid-state gate-controlled switching means 25, and gate control means 32 responsive to the time-related control signal generated by the timing means 26. The gate control means 32 has an output 34 connected to the gate 36 to control the mode of the ballasting means 20.

The illumination system 10 functions as follows: After the main switching means 22 switches to the closed state and when the digital counter 30 counts the predetermined number of pulses from the oscillator 28, the digital counter 30 initiates the time-related control signal. The gate control 32 responds to the control signal to place the ballasting means in the second operating mode until the system is de-energized by the main switching means 22. The system 10 is thereafter quiescent until the main switching means is again switched to the closed state to initiate counting of the timed pulses by the digital counter 30.

The digital counter 30 of system 10 preferably has a reset state corresponding to a number at which the count begins and the generated timed pulses of the oscillator means 28 has a high frequency mode for resetting the digital counter 30, and a low frequency mode to cause the digital counter 30 to initiate the time-related control signal after the predetermined number of timed pulses have been counted.

The system 10 also desirably includes control means 38 for initially upon energization of the ballasting means 20 starting the high frequency mode of the oscillator means 28 until the digital counter 30 is reset and then stopping the high frequency mode and starting the low frequency mode and permitting the oscillator 28 to operate until the counter 30 initiates the time-related control signal.

Figure 2:
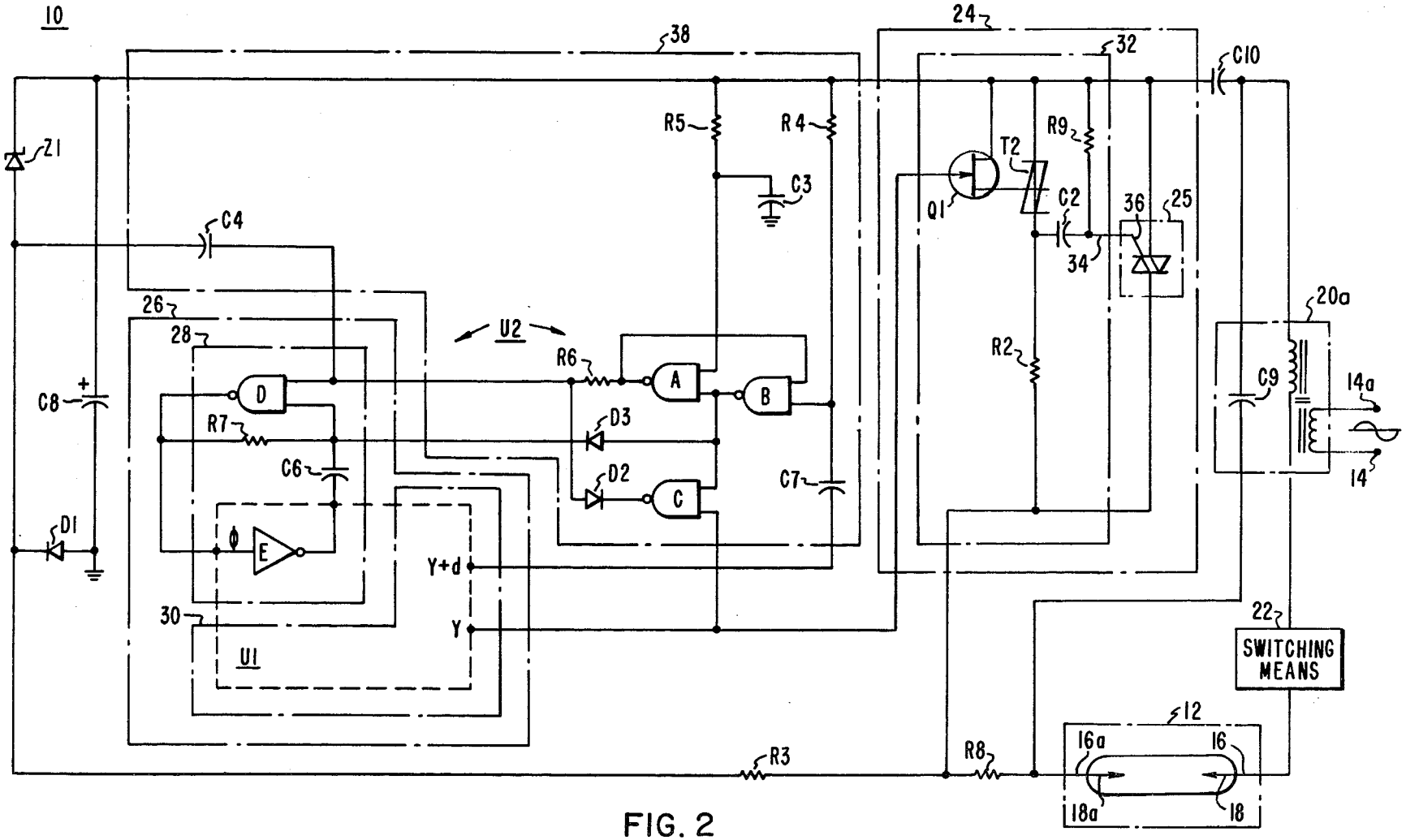
FIG. 2 is a schematic diagram showing a preferred circuit configuration of the invention with a regulated output ballast.

The following table of components specifies typical values for use in the circuits shown in FIGS. 1 and 2.

TABLE

| Component | Value |
|---|---|
| 12 | 400 W Hg |
| 20 | 240 VAC, 400 W Hg, lag ballast |
| 22 | Photocontrol |
| 24,25 | 6A, 500 VAC switch, Electronic Control Corporation Part No. Q5006 I |
| Q1 | 2N4222 N channel, junction fet |
| T1 | 40 V trigger diode (DIAC), ECC |
| T2 | MBS 4991, Motorola gated trigger |
| U1 | CD 4045 AD, RCA COS/MOS 21-stage counter, plastic, includes inverter labeled E |
| U2 | CD 4011AD, RCA COS/MOS Quad 2 Input NAND Gates, plastic, labeled A, B, C, D |
| C1 | .047 μf, 100V |
| C2 | .047 μf, 100V |
| C3 | .1μf, 100V |
| C4 | .0047μf, 100V |
| C5 | .001μf, 100V |
| C6 | 100μμf, 100V |
| C7 | .001μf, 100V |
| C8 | 15μf, 15V, epoxy-dipped tantalum |
| C9 | 12μf, 240 VAC |
| C10 | 12μf, 240 VAC |
| D1 | 1N457 20ma, 60V |
| D2 | 1N457 20ma, 60V |
| D3 | 1N457 20ma, 60V |
| Z1 | 8.2V, 10%, .4W zener diode 1N959 |
| R1 | 100K, 5%, ½W carbon |
| R2 | selected, ½W carbon |
| R3 | 27K, 5% 1W |
| R4 | 470K, 5%, ¼W carbon |
| R5 | 470K, ¼W carbon |
| R6 | 100K, ¼W carbon |
| R7 | 1M, ¼W carbon |
| R8 | 1μ, 5W |
| R9 | 1K, 5%, ¼W, carbon |

Referring to FIG. 1 the operation of the circuit is as follows:

For a lag-type ballast the solid-state gate-controlled switch means 25 is in series with the lamp 12 and the lag ballast 20. For the lag ballast 20 to be put in the second operating mode or the dim mode, the gate-controlled switch 25 must conduct a predetermined percentage of each half cycle less than when in the first operating mode. The electronic portion of the circuit shown in FIG. 1 is powered by the voltage that appears across gate-controlled switch 25, so that switch 25 is never permitted to be on 180° out of every half cycle. There is always a small 10° or 20° period in the beginning of each half cycle when gate-controlled switch 25 is off even when the ballasting means is in the first operating mode. This causes the switch 25 to produce a 100-volt pulse each half cycle. This pulse via R3, D1 and C8 becomes the power supply for the electronic circuit. The value of the supply voltage is determined by zener diode Z1 which is set at about 10 volts, for example. This condition exists when the voltage on R3 is negative and the voltage on the positive terminal of C8 is positive. In the next half cycle when the line voltage reverses, the current flows through R3 into the anode of Z1 out the cathode of Z1 to the other side of the power line, which results in D1 being essentially non-conductive, and C8 powers the electronic circuit, in essence being a half wave power supply. In the first operating mode the lamp 12 being a 400 L W Hg lamp, for example, operates at about rated power. When the ballast is in the second operating mode the 400 W Hg lamp operates at about 250 W.

The digital counter means 30 of the counting means 26 as shown in FIG. 1 is a 21-stage dividing circuit. It requires $2^{21}$ timed input pulses through the input labeled $\phi$ of the digital counter 30, which is equivalent to receiving 2,079,152 timed input pulses before an output pulse corresponding to the time-related control signal is generated at the output terminal labeled Y of the digital counter 30. As shown in FIG. 1 there is also an additional output terminal labeled Y+d. The difference between the occurrence of the Y+d output pulse and the Y output pulse is a delay of one-half the total timed period. Thus, the digital counter 30 produces two output pulses for the total timed period. The time between the output pulses is equal to the time it takes the digital counter 30 to count $2^{20}$ input pulses.

The high frequency mode of the oscillator means 28 for resetting digital counter 30 is produced by C6, R7, NAND gate D and the inverter E. This forms an oscillator having a frequency of about 100 kHz. Whether or not the high frequency mode of the oscillator means 28 is running, is controlled by the control means 38.

The control means 38 functions as follows:

Referring to FIG. 1 when the circuit is initially energized C8 charges, and C3 is uncharged. If the voltage on C3 is low, or in a logic state "0," the high frequency mode of the oscillator means 28 will be activated. The high frequency mode is activated when one of the inputs to the NAND gate labeled A is "0" because it is the same as the voltage on C3 that produces the logic "1" at the output of A. The logic "1" at A means that there is a logic "1" at one of the inputs to NAND gate D. Thus, the other input to NAND gate D becomes the controlling terminal. If this terminal is high, or a logic "1," the output of D will be low, or a logic "0." If this input terminal is "0," then the output will be "1." This terminal is part of the high frequency mode of the oscillator means 28. By driving this control input terminal to D to a logic "0" the high frequency mode of the oscillator means 28 is permitted to operate. It will continue to operate until the high frequency mode is discontinued via D3. Whenever the cathode side of C7 is pulled negative, which occurs somewhere in the timing cycle when the digital counter 30 has counted $2^{20}$ timed pulses, the Y+d output of the digital counter 30 will go to a logic "1" for a short period of time and then go to a logic "0." When the Y+d output goes to "0" it pulls the cathode side of C7 down which pulls one of the input gates to NAND gate B low or to a logic "0." A logic "0" zero at one of the inputs to NAND gate B causes a "1" at the output of NAND gate B. With the output of B high, positive current will flow through the anode of D3 and drive the junction of R7, C6, D3 high or to a logic "1" which drives one of the inputs to the NAND gate D high and stops the high frequency mode of the oscillator means 28. At this point the digital counter 30 is reset to the beginning number which in this embodiment is zero. The low frequency mode of the oscillator means 28 then takes over.

The generated timed pulses of the low frequency mode are produced by the 60-cycle AC supply. C4 connected to the tie point of Z1, D1 and R3 couples the 60-cycle supply into one of the inputs of NAND gate D. This point goes low or to a logic "0" once every cycle in the 60-cycle period. When this point goes low the output of the NAND gate D goes high or to a logic "1" causing the low frequency mode or 60-cycle mode to generate timed pulses to the terminal labeled $\phi$ of the digital counter 30. The low frequency mode of the oscillator means 28 will continue until the time-related control signal is generated at the output terminal Y. This will occur after $2^{20}$ timed pulses have been generated by the 60-cycle supply or about $4\frac{1}{2}$ hours. When the time related control signal is generated, it is generated as a high or logic "1." When the output of Y goes to a logic "1," one of the inputs to NAND gate C will be at a logic "1" and if the other input to C is at a logic "1," the output of C will go to a logic "0" via D2 thereby clamping the junction of C4 and one of the inputs of NAND gate D permanently low or a logic "0." If this input is permanently low, the low frequency mode of the oscillator means 28 stops. As stated before, for this to happen NAND gate C has to have both of its inputs high or at a logic "1" and the one input is high because Y is high. The other input of C is the output of NAND gate B. For B to be high one of its two inputs must be low or a logic "0" and the input that is low is the output of NAND gate A.

When the Y output of the digital counter 30 is at a logic "0" or at ground potential, before the low frequency mode of the oscillator means 28 is stopped, the source of Q1 is tied to the B+ potential or 10 volt supply and the gate potential is sufficiently low to keep Q1 turned off. With Q1 turned off, trigger diode T2 has an open gate terminal such that device T2 is permitted to trigger whenever the voltage across it reaches 8 volts. The voltage across T2 reaches 8 volts when the voltage across C2 reaches 8 volts. Of course, this assumes that there is a resistor inside the gate-to-cathode region of the gate-controlled switching means 25 so that all the voltage across C2 appears across T2. C2 is charged each half cycle through R2 with a very slight time delay of less than 1 millisecond. With the gate-controlled switching means 25 off, the line voltage appears across R2 and C2. C2 charges up until it reaches the 8-volt trigger potential of T2 at which time T2 turns on, C2 is discharged into the gate of the gate-controlled switch 25. Switch 25 is thereby turned on and current is caused to flow through the ballast 20 into the lamp 12.

With the Y output of the digital counter 30 low or at a logic "0," the gate-controlled switch 25 will be on most of each half cycle with a slight off time at the beginning of each half cycle to power the electronic circuit as hereinbefore mentioned. This process continues until the low frequency mode of the oscillator means 28 is stopped. As already stated, the low frequency mod is stopped with the time-related control signal generated at the Y output of digital counter 30 and the generated time-related control signal appears as a high or logic "1" so that the gate of Q1 is tied to the B+ supply so that there is no reverse bias on the source-to-gate junction of Q1. Q1 is normally an ON device so that the gate terminal of T2 is tied to the B+ supply, and this makes it impossible to trigger T2. However, in parallel with the R2, C2 circuit is another circuit formed by R1, C1 and trigger diode T1, so that when the trigger diode T2 ceases to function, the charging of C1 through R1 will eventually cause C1 to reach the trigger potential of T1 at which time T1 will fire causing the gate-controlled switch 25 to be turned on. By properly selecting the values for R1, C1 and T1 such as those listed previously, the switch 25 turns on at a time later in the cycle constituting the second operating mode of the controlled switching means 24. The later in the cycle switch 25 is turned on, the lower will be the second operating mode or dim mode power setting for the ballasting means 20.

Gate-controlled switch 25 as used in this embodiment can conduct current in either the positive or negative direction and it can be turned on with either positive or negative gate current, but it is most sensitive to being turned on with positive gate current when it has a positive anode voltage and, likewise, it is most sensitive to being turned on with negative current when the anode voltage is negative. The circuit shown of the gate control means 32 is designed to achieve this result.

The typical regulated output (R.O.) type ballast has a capacitor in series with the lamp. The power to the lamp can be controlled by changing the effective value of this capacitor. This is accomplished in the circuit shown in FIG. 2 by having two capacitors C9 and C10 in the circuit. C9 of the R.O. ballast **20*a* is in series with the lamp 12 and capacitor C10 in series with the solid-state gate-controlled switch 25 and R8 forms a parallel circuit with C9. When gate-controlled switch 25 is on, assuming R8 is a fairly small value, the total capacitor becomes C10 in parallel with C9. If switch 25 is off, the total capacitor is just C9 which is a smaller capacitor. Therefore, for the first operating mode of the ballasting means 20*a* the gate-controlled switch 25 is conducting. This occurs because the Y output of digital counter 30 is low and Q1 is off so that the gate terminal of T2 is open and T2 is permitted to trigger whenever the voltage across it reaches 8 volts. The voltage across T2, as in the lag-type ballast, reaches 8 volts when the voltage across C2 reaches 8 volts so that after a slight time delay the gate-controlled switch 25 conducts. Upon the time-related control signal being generated at the Y output of digital counter 30, Q1 turns on and T2 is not permitted to trigger thereby maintaining he gate-controlled switch 25 off and removing C10 from the circuit. In this condition C9 alone is in series with the lamp 12 and the ballast 20*a* is in the second operating mode or dim mode. The circuit as shown for the regulated output ballast, like the circuit for the lag-type ballast, is designed so that the gate-controlled switch 25 is turned on in a like manner as hereinbefore described. R9 is included in this circuit merely as a discharge path for C2**.

I claim:

1. An energy-conserving solid-state-controlled illumination system which operates lamp means at about a predetermined rated power consumption with a relatively high light output for a predetermined time when a high degree of illumination is desirable and operates said lamp means at about a predetermined power less than rated power consumption when a lower degree of illumination can be tolerated, said sysem comprising:

a. input terminal means adpated to be connected to a source of electrical energy, and output terminal means adapted to be connected to the input terminals of said lamp means;

b. lamp ballasting means in circuit with said lamp means, said lamp ballasting means having a first operating mode in which the average power passed to said lamp means causes same to operate at about rated power consumption, and said lamp ballasting means having a second operating mode in which the average power passed to said lamp means is a predetermined amount less than the rated power consumption for said lamp means;

c. main switching means having an open state and a closed state, said switching means connected in circuit with said input terminal means and said lamp ballasting means to energize said lamp means when said switching means is in said closed state and to de-energize said lamp means when in said open state;

d. controlled switching means, the controlled closing and opening of which determines whether said ballasting means is in said first operating mode or said second operating mode;

e. timing means responsive to closing of said main switching means and operable to generate a time-related control signal a predetermined period of time after closing of said main switching means, said time-related control signal applied to said controlled switching means to switch same from said first operating mode to said second operating mode until said system is de-energized by said main switching means, and said system is thereafter quiescent until said main switching means is again closed.

2. The illumination system of claim 1, wherein said timing means comprises oscillator means for generating timed pulses after closing said main switching means, digital counter means for counting a predetermined number of pulses generated by said oscillator means, and said digital counter means initiating said time-related control signal after said pedetermined number of pulses are counted.

3. The illumination system of claim 2, wherein said controlled switching means comprises a solid-state gate-controlled switching means.

4. The illumination system of claim 3, wherein said controlled switching means further comprises gate control means responsive to the time-related control signal generated by said timing means and having an output connected to the gate of said gate-controlled switching means to control the mode of said ballasting means, and after said main switching means is switched to said closed state and when said digital counter means counts said predetermined number of pulses from said oscillator means, said digital counter means initiates said time-related control signal, said gate control means responding to said control signal to place said ballasting means in said second operating mode until said system is de-energized by said main switching means, and said system is thereafter quiescent until said main switching means is again switched to said closed state to initiate counting of said timed pulses by said digital counter means.

5. The illumination system of claim 2, wherein said digital counter means has a reset state corresponding to a number at which said count begins, said generated timed pulses of said oscillator means having a high frequency mode for resetting said digital counter means, and a low freqency mode for causing said digital counter means to initiate said time-related control signal after said predetermined number of timed pulses have been counted.

6. The illumination system of claim 5, wherein said system further comprises control means for initially upon energization of said ballasting means starting said high frequency mode of said oscillator means until said digital counter is reset and then stopping said high frequency mode and starting said low frequency mode and permitting said oscillator means to operate until said counter initiates said time-related control signal.

* * * * *